United States Patent [19]

Nömtak

[11] 4,399,981

[45] Aug. 23, 1983

[54] VESSEL FOR MOLTEN METAL

[76] Inventor: Ants Nömtak, Tegnervägen 8, S-802 28 Gävle, Sweden

[21] Appl. No.: 306,393

[22] Filed: Sep. 28, 1981

[30] Foreign Application Priority Data

Oct. 1, 1980 [SE] Sweden ..... 806866

[51] Int. Cl.[3] ..... C21B 3/00

[52] U.S. Cl. ..... 266/275; 266/283

[58] Field of Search ..... 266/275, 285, 286, 283, 266/281

[56] References Cited

U.S. PATENT DOCUMENTS

| | | | |
|---|---|---|---|
| 3,345,059 | 10/1967 | Swindt | 266/275 |
| 3,415,483 | 12/1968 | Charman, Jr. et al. | 249/201 X |
| 4,012,029 | 3/1977 | Seguin et al. | 266/275 |
| 4,055,336 | 10/1977 | Massin | 266/283 |
| 4,202,538 | 5/1980 | Shimada et al. | 266/275 |

FOREIGN PATENT DOCUMENTS

| | | | |
|---|---|---|---|
| 2001155A | 3/1978 | United Kingdom | 266/275 X |

*Primary Examiner*—L. Dewayne Rutledge
*Assistant Examiner*—David A. Hey
*Attorney, Agent, or Firm*—Hill, Van Santen, Steadman & Simpson

[57] ABSTRACT

A holding furnace for molten metal comprises an inner vessel formed of flat, rigid, heat-resistant panels. The panels are held in sealing engagement with one another at abutting edge surfaces by the action of inwardly directed pressure applied to the panels by an integrally cast refractory outer vessel through the intermediary of a resilient layer of heat-resistant fibrous material. The pressure is applied as a result of the shrinking that the casting compound undergoes during the setting. When the inner vessel is being made, the panels, to which the resilient layer has initially been applied, are held together by the action of a reduced pressure in the inner vessel as the latter is positioned in a furnace casing interiorly lined with a mineral wool insulation. The inner vessel then is cast around with a refractory casting compound for forming the outer vessel.

4 Claims, 4 Drawing Figures

VESSEL FOR MOLTEN METAL

BACKGROUND OF THE INVENTION

1. Field of the Invention

This invention relates to a vessel for molten metal comprising a box-like inner vessel having bottom and side walls formed by rigid heat-resistant panels which are sealingly joined together along confronting edge surfaces at the inside corners defined by the bottom and side walls, and a heat insulation covering the outer side of the bottom and side-wall panels of the inner vessel.

The vessel according to the invention is particularly useful in a furnace for holding molten metal at a controlled temperature, e.g. in die-casting installations, but it also has other uses.

2. Prior Art

Available on the market are heat-resistant panels which can readily be machined by means of ordinary cutting tools, such as saws, drills and milling cutters, and which, in the grades now available, can endure temperatures of 700°–800° C. and extended periods of contact with molten metal. Such panels have also been used in vessels of the above-defined kind.

A known furnace for holding molten metal at temperatures up to 700°–800° C. includes a vessel of the above-defined kind. In that vessel, the panels forming the bottom and side walls of the inner vessel are secured together by means of self-tapping screws passed through the confronting joint surfaces of the panels and engaging directly the material of the panels. A sealing strip of refractory felt is interposed between the confronting surfaces of the joints (GB-A-2 001 155 A).

Because the coefficient of thermal expansion of the panels is substantially lower than that of the screws, relative movements of the screws and the surrounding material of the panels are unavoidable. As a consequence of such movements, the screws may gradually lose their hold so that they become unable to clamp the panels together with sufficient force to prevent leakage of metal through the joints.

SUMMARY OF THE INVENTION

An object of the invention is to provide a vessel of the above-defined kind which reliably maintains the tightness of the joints between the panels of the inner vessel.

The vessel according to the invention has no screws or other fasterners passing through the confronting surfaces of the joints. Instead, the panels of the inner vessel are held together by pressure exerted on the outer sides of the panels through the intermediary of a resilient layer of heat-resistant fibrous material by the heat insulation surrounding the inner vessel. The resilient layer constantly exerts the inwardly directly pressure on the panels and at the same time permits the unavoidable thermal movements of the panels without loss of the sealing action of the joints. The resilient layer of fibrous material in turn is constantly compressed by the outer vessel which is integrally cast from a refractory casting compound.

It has been found in practice that if the confronting surfaces of the joints are accurately machined, the panels of the inner vessel can be sealingly held together without the use of separate felt strips or other sealing elements interposed between the joint surfaces. The required machining accuracy can normally be accomplished without problems using conventional machining techniques. In certain cases it may be preferable, however, for reasons of production economy, or otherwise, to use a felt strip or other separate sealing element in the joints, and such use is within the scope of the invention as defined in the claims.

The vessel according to the invention may be made in a particularly simple and economic manner if in accordance with the method defined in claim 6a reduced pressure is produced in the inner vessel to hold the panels together in their proper relative positions while the inner vessel is placed in a casing and cast around with a refractory casting compound for forming the outer vessel. When the casting compound has been poured into the casing and surrounds the inner vessel including the resilient layer of fibrous material provided on the outer side of the latter, the casting compound retains the panels of the inner vessel in their proper relative positions after the reduced pressure has disappeared, and the unavoidable shrinking of the casting compound then causes the resilient layer of fibrous material to be permanently compressed so that it then constantly clamps the panels together. Heating of the finished vessel to the operating temperature and the consequent thermal expansion of the panels will augment the clamping together of the panels.

For a full understanding of the invention, reference is made to the following description of a holding furnace including a vessel embodying the invention, reference being made to the accompanying drawings.

DETAILED DESCRIPTION

Figure 1:
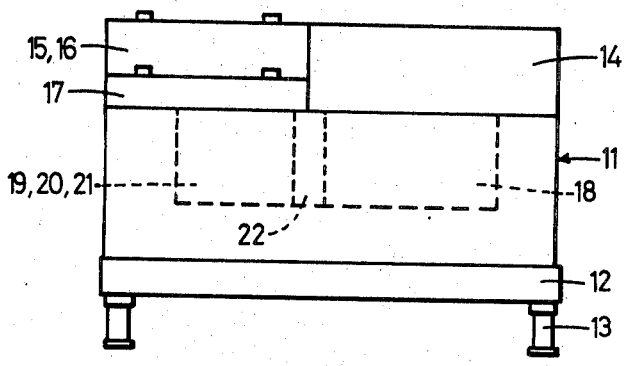
FIG. 1 is a side elevational view of the holding furnace.
Figure 2:
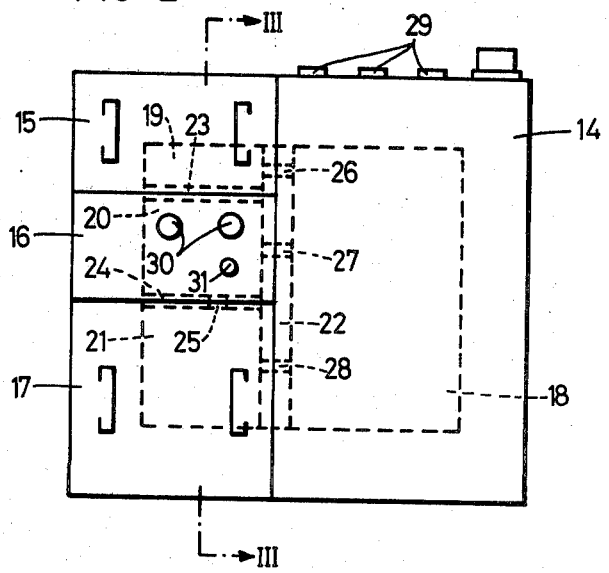
FIG. 2 is a plan view of the holding furnace.

The furnace shown in FIGS. 1 and 2 is to be used for holding molten casting metal at temperatures up to 700°–800° C., e.g. in die-casting installations. The furnace is thus charged with molten metal which is then removed by a handle ladle or other means. Other uses may be contemplated, however.

The furnace has a vessel section 11 supported by a base plate 12 with feet 13 and covered by a plurality of removable cover sections 14, 15, 16 and 17.

Four compartments 18, 19, 20 and 21, the outlines of which are marked by broken lines, are provided within the vessel section 11. Compartment 18 is the largest compartment and constitutes the holding compartment, while compartment 19 is a charging compartment, compartment 20 is a measuring compartment and compartment 21 is a discharging compartment. Compartment 18 is separated by a first vertical partition 22 from the other compartments 19, 20, 21 which in turn are separated from one another by short vertical partitions 23 and 24. Openings 25, 26, 27 and 28 in the partitions 22 and 24 permit communication between the compartments. The partitions are made of the same material as the bottom and side-wall panels referred to below.

The holding compartment 18 is covered by the cover section 14 in which electric heaters 29 are mounted. The charging compartment 19 is covered by the cover section 15 on which handles are provided. The measuring compartment 20 is covered by the cover section 16 which is provided with temperature sensors 30 and a level sensor 31. The discharging compartment 21, is covered by the cover section 17 which is also provided with handles and somewhat thinner and lighter than the other cover sections in order that it may be manipulated manually with little physical effort.

The cover sections 14–17 rest directly on the flat and horizontal upper edges of the vessel section 11. The cover sections abut one another at vertical planes passing through the partitions, as shown in FIG. 2.

Figure 3:
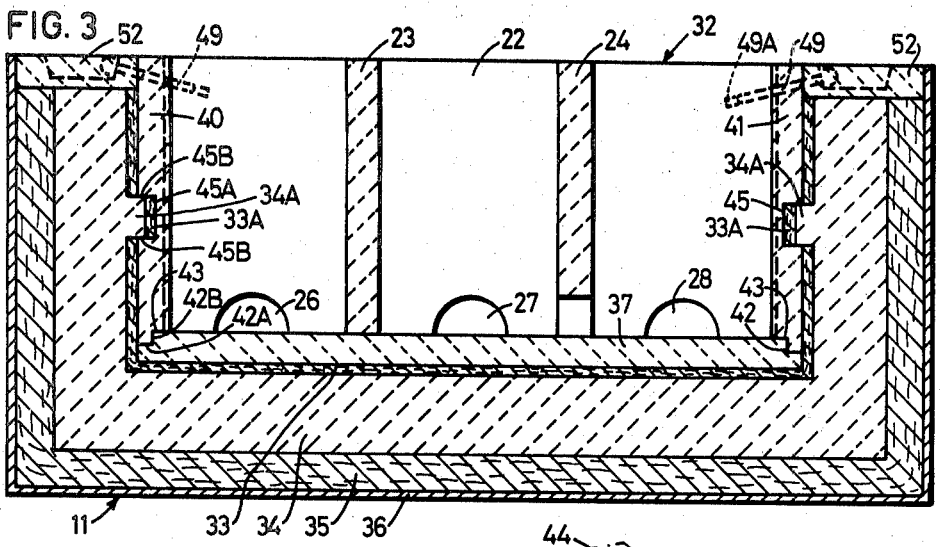
FIG. 3 is an enlarged view in vertical section on line III—III of FIG. 2 showing a vessel embodying the invention and forming part of the furnace.

FIG. 3 shows the vessel section 11 in greater detail. It comprises a box-like inner vessel 32, in which the partitions 22, 23, 24 are mounted, and a heat insulation covering the outer sides of the bottom and side walls of the inner vessel. The heat insulation comprises a resilient layer 33 of heat-resistant fibrous felt, e.g. of the type commercially available under the designation Cerablanket (Johns-Manville Corporation, Denver, Colorado, USA), density 128 kg/m$^3$, an integrally made box-like outer vessel 34 of ceramic or refractory casting compound, e.g. of the type commercially available under the designation Cellcrete 19 (Johns-Manville Corporation, Denver, Colorado, USA), and a layer 35 of diabase or other mineral or rock wool covering the outer sides of the bottom and side walls of the outer vessel. The entire inner and outer vessel structure is enclosed in a box-like sheet metal casing 36.

Apart from the partitions, the inner vessel 32 comprises flat rectangular panels of a heat-resistant material, e.g. the ceramic-type material commercially available under the designation Marinite 45 (Johns-Manville Corporation, Denver, Colorado, USA), density 720 kg/m$^3$, namely, a bottom-wall panel 37 and four vertical side-wall panels 38, 39, 40 and 41. Sometimes, the panels 38 and 39 are herein termed end-wall panels, while the panels 40 and 41 are termed long-wall panels.

Figure 4:
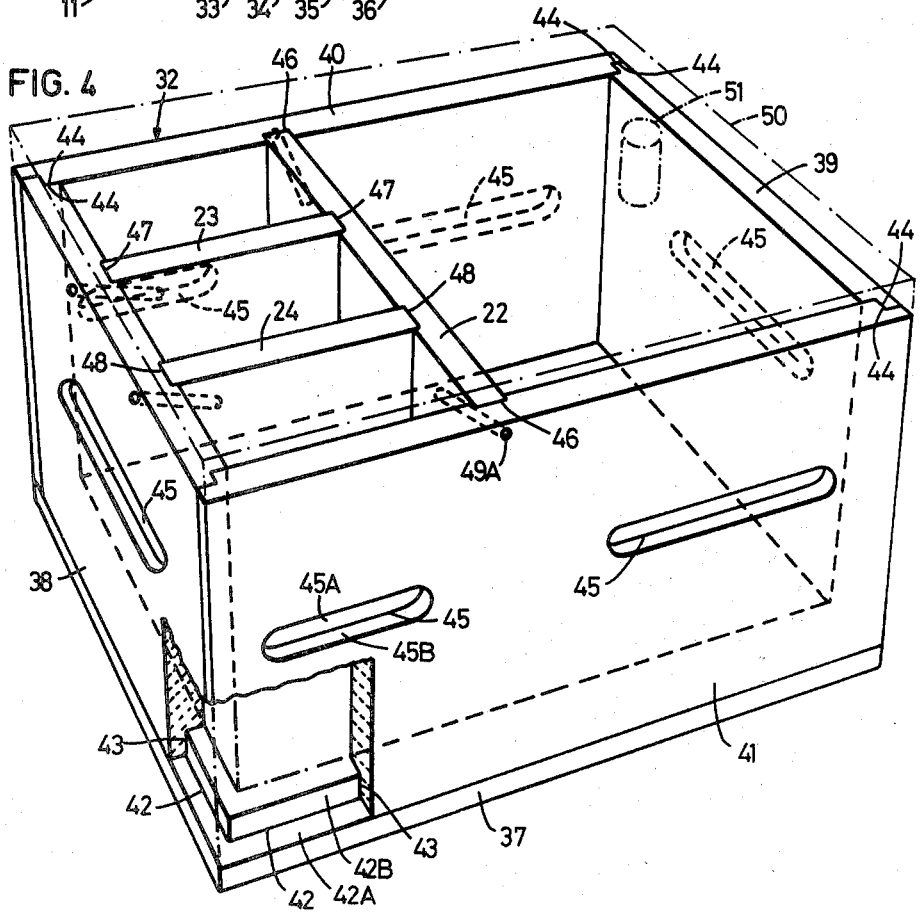
FIG. 4 is a perspective view of the inner vessel of the vessel shown in FIG. 3.

Along its entire periphery, the bottom-wall panel 37 has an outwardly and upwardly open rebate 42 defined by a horizontal surface 42A and a vertical surface 42B. The surfaces defining the rebate both have a width equal to one-half of the panel thickness. The side-wall panels 38–41 are provided with mating rebates 43 along their lower edges, and as best seen in FIG. 4, their vertical edges are provided with similar mating rebates 44. At their lower edges and also at their vertical edges, that is, at the inside corners between the bottom-wall panel 37 and each side-wall panel 38–41 and between adjacent side-wall panel 38–41, the panels 37–41 abut one another along Z-shaped joints formed partly by the rebates 42, 43, 44 and partly by the adjoining narrow marginal areas of the upper side of the bottom-wall panel 37 and of the inner side of the longwall plates 40, 41.

The confronting surfaces forming the joints between the panels 37–41 are planar and in the illustrated embodiment abut or engage one another directly, that is, no separate sealing element is inserted between the surfaces of the joints. Tightness of the joints is ensured by pressing the panels against one another in a manner explained below. In accordance with the invention, the panels 37–41 are held together substantially exclusively by pressure directed towards the interior of the inner vessel and acting on the lower side of the bottom-wall panel 37 and the outer sides of the side-wall panels 38–41. Thus, there are no separate fasteners holding the panels together, and accordingly, there are no elements forming thermal bridges across the joints and performing undesired thermal movements relative to the joints.

The pressure acting on the panels 37–41 to hold them together is exerted over substantially the entire surface area of the panels by the outer vessel 34 through the intermediary of the resilient fibrous felt layer 33 which is constantly held in a compressed state between the panels and the outer vessel. This compression is a result of the shrinking that the casting compound of the outer vessel 34 undergoes during the manufacturing process and is augmented by the thermal expansion of the panels resulting from their being heating to the operating temperature.

As shown in FIGS. 3 and 4, the outer side of each sidewall panel 38–41 is provided with one or a pair of horizontal grooves 45 having a flat bottom 45A and flat horizontal walls 45B. The felt layer 33 is provided with an opening which is congruent and in register with each groove 45, and a complementary piece 33A of the felt layer covers the bottom 45A of the groove. The walls 45B of the groove, however, are not covered, apart from the small portions covered by the felt piece on the bottom of the groove. (In FIG. 3 and partly also in FIG. 4 some dimensions are exaggerated in the interest of clarity).

As also shown in FIG. 3, the outer vessel 34 has inwardly directed projections 34A complementary to and received in the grooves 44. These projections provide a positive interlocking in the vertical direction of the side-wall panels 38–41 and the outer vessel 34 which serves to maintain the compressed condition of the felt layer 33 between the bottom-wall panel 37 and the outer vessel 34.

The partition 22 is slidably received in opposing vertical grooves 46 in the long-wall panels 40, 41, and the partitions 23 and 24 are each slidably received in opposing vertical grooves 47, 48 in the end-wall panel 38 and the partition 22. A pair of headed pins 49 (FIG. 3) removably inserted in inclined bores 49A in the upper portion of the partition 22 and the upper portion of the long-wall panels 40, 41 serve to lock the partition to the long-wall panels. Similar pins (not shown) lock the partitions 23 and 24 to the end-wall panel 38 and the partition 32.

The illustrated vessel may advantageously be made in the following manner.

The panels 37–41 are placed in their final relative positions without securing them together. Thus, no fasteners are used to permanently secure the panels together but a suitable fixture or other temporary holding means may be used to prevent the panels from falling apart. Preferably, the fibrous felt layer 33 has been applied earlier. A cover then is positioned over the inner vessel 32 thus formed as shown in phantom lines at 50 in FIG. 4. The cover 50 is sealingly engaged with the upper side of the inner vessel 32 formed by the panels, and the air in the inner vessel is partially evacuated through a suction hose 51 connected to the cover so that a reduced pressure is maintained which serves to hold the panels together in their proper relative positions. If the fibrous felt layer 33 has not been applied earlier, it is applied at this stage of the procedure.

After the sheet metal casing 36 has been interiorly lined with the insulation layer 35 and the semi-fluid refractory casting compound has been poured into the thus lined casing up to the desired level of the lower side of the portion of the felt layer covering the bottomf-wall panel 37, the partially evacuated inner vessel 32 is positioned centrally in the casing and supported on the layer of casting compound therein. While the partially evacuated inner vessel 32 is maintained in proper position in the casting mold formed by the sheet-metal casing 36 and the insulation 35, additional casting compound is poured into the space between the inner vessel and the insulation 35. The casting compound then is caused to set before the evacuation of the inner vessel 32 is discontinued. The upper portion of the space between the inner vessel and the casing or the insulation is covered by a strip 52 made of the same material as the panels of the inner vessel. As the casting compound forming the outer vessel 34 sets, it undergoes a certain degree of shrinking and it therefore subjects the fibrous felt layer 33 to a compressing pressure acting over substantially the entire surface area thereof and directed toward the interior of the inner vessel. Such pressure is transmitted by the fibrous felt layer 33 to the lower side of the bottom-wall panel 37 and the outer sides of the side-wall p;anels 38–41. As a consequence, in the finished structure the panels are constantly urged into sealing face-to-face engagement with one another along the abutting joint surfaces adjacent the edges of the panels.

I claim as my invention:

1. A vessel for molten metal, comprising:

a box-like inner vessel having bottom and side walls formed by rigid heat-resistant panels which are sealingly joined together along confronting edge surfaces at the inside corners defined by the bottom and side walls, and a heat insulation covering the outer sides of the bottom and side-wall panels of the inner vessel, wherein the improvement comprises:

the panels of the inner vessel being held together substantially exclusively by pressure exerted on them by the insulation and directed toward the interior of the inner vessel, and the insulation including a compressed resilient layer of heat-resistant fibrous material engaging and covering the outer sides of the panels, and a box-like outer vessel integrally cast from a refractory casting compound and engaging the outer side of said resilient layer.

2. A vessel according to claim 1 in which the insulation also comprises an outer layer of fibrous material engaging the outer sides of the bottom and side walls of the outer vessel and in which said outer layer is covered by a sheet metal casing.

3. A vessel according to claim 1 in which the outer sides of the side-wall panels of the innner vessel are provided with recesses receiving complementary projections on the inner side of the side walls of the outer vessel.

4. A vessel according to claim 3 in which the depth of the recesses is larger than the thickness of said resilient layer and in which the bottom surfaces of the recesses are covered by said resilient layer while at least a major portion of the side walls of the recesses are bare.

* * * * *